United States Patent [19]

Choby, Jr.

[11] 4,032,366

[45] June 28, 1977

[54] GRAIN-ORIENTED SILICON STEEL AND PROCESSING THEREFOR

[75] Inventor: Edward G. Choby, Jr., Pittsburgh, Pa.

[73] Assignee: Allegheny Ludlum Industries, Inc., Pittsburgh, Pa.

[22] Filed: May 23, 1975

[21] Appl. No.: 580,449

[52] U.S. Cl. ..... 148/31.5; 148/113

[51] Int. Cl.[2] ..... C22B 33/00; H01F 1/04

[58] Field of Search ..... 148/113, 112, 111, 31.5, 148/27, 110, 122; 427/127, 128, 129, 130; 428/432, 433

[56] References Cited

UNITED STATES PATENTS

| | | | |
|---|---|---|---|
| 2,351,922 | 6/1944 | Burgwin | 148/112 |
| 2,501,846 | 3/1950 | Gifford | 148/110 |
| 2,809,137 | 10/1957 | Robinson | 148/113 |
| 3,418,710 | 12/1968 | Seidl et al. | 148/112 |
| 3,562,011 | 2/1971 | Hirst et al. | 148/113 |
| 3,575,739 | 4/1971 | Fiedler | 148/111 |
| 3,582,409 | 6/1971 | Kohler | 148/111 |
| 3,594,240 | 7/1971 | Foster et al. | 148/113 |
| 3,687,742 | 8/1972 | Foster et al. | 148/113 |
| 3,720,549 | 3/1973 | Hirst et al. | 148/113 |
| 3,793,073 | 2/1974 | Kitayama et al. | 148/31.5 |
| 3,996,073 | 12/1976 | Evans | 148/6.15 R |

*Primary Examiner*—Walter R. Satterfield

*Attorney, Agent, or Firm*—Vincent G. Gioia; Robert F. Dropkin

[57] ABSTRACT

A process for producing grain-oriented silicon steel, and the steel produced thereby. The process includes the steps of: preparing a melt of silicon steel; casting the steel; hot rolling the steel; cold rolling the steel; decarburizing the steel; final texture annealing the steel; coating the steel with an aqueous solution comprised of from 4 to 30% of phosphate ion, up to 6% magnesium ion, 5 to 34% colloidal silica and 0.15 to 6% hexavalent chromium; and curing the coated steel at a temperature of at least 1200° F.

7 Claims, No Drawings

GRAIN-ORIENTED SILICON STEEL AND PROCESSING THEREFOR

The present invention relates to an improvement in the manufacture of grain-oriented silicon steel.

The core loss of grain-oriented silicon steel provides a measure as to the efficiency of an electromagnetic device made from the steel. High core losses represent low efficiency and, moreover, create heat which must be dissipated. Consequently, there is a need to lower the core loss of silicon steel. This is particularly true at high operating inductions which are becoming more and more common with today's advanced equipment.

The present invention provides a means for decreasing the core loss of grain-oriented silicon steel. More specifically, it employs a finish coating which places silicon steel in tension, on cooling from the temperature at which the coating is cured. In terms of chemistry, it specifies an aqueous coating solution which is generally comprised of phosphate ion, magnesium ion, colloidal silica and hexavalent chromium. The coating is applied to the steel subsequent to its final texture anneal.

As noted hereinabove, coatings such as that employed in the present invention are referred to as finish coatings. Another finish coating is disclosed in U.S. Pat. No. 3,207,636. It differs from the coating employed in the present invention in that it requires boric acid and does not disclose the use of colloidal silica. Moreover, it does not disclose silicon steel in a state of tension of at least 800 psi. On the other hand, the present invention provides grain-oriented silicon steel in such a state of tension.

It is accordingly an object of the present invention to provide an improvement in the manufacture of grain-oriented silicon steel.

In acccordance with the present invention, a melt of silicon steel is subjected to the conventional steps of casting, hot rolling, one or more cold rollings, an intervening normalize when two or more cold rollings are employed, decarburizing and final texture annealing; and to the improvement comprising the steps of coating the annealed steel with an aqueous solution comprised of from 4 to 30% phosphate ion, up to 6% magnesium ion, 5 to 34% colloidal silica and 0.15 to 6% hexavalent chromium, heating the coated steel at a temperature of at least 1200° F to cure the coating, and cooling the coated steel. The coating places the steel in tension on cooling from the temperature at which it is cured. Specific processing, as to the conventional steps, is not critical and can be in accordance with that specified in any number of publications including U.S. Pat. Nos. 2,867,557 and 3,855,020. Although the invention is particularly adaptable to the manufacture of grain-oriented steels having a cube-on-edge orientation, it is believed to be adaptable to all oriented steels. A particular cube-on-edge steel is produced from a melt consisting essentially of, by weight, up to 0.07% carbon, from 2.6 to 4.0% silicon, from 0.03 to 0.24% manganese, from 0.01 to 0.09% of material from the group consisting of sulfur and selenium, from 0.015 to 0.04% aluminum, up to 0.02% nitrogen, up to 0.5% copper, up to 0.0035% boron, balance iron.

As noted hereinabove, the coating employed in the present invention places silicon steel in a state of tension of at least 800 psi, and preferably at least 1200 psi. A factor contributing to this high state of tension is, of course, the size of grain-oriented silicon steel sheets.

More specifically, these sheets are generally less than 0.014 inch thick. Also contributing to the state of tension, and most significantly so, is the synergistic effect of the substances which make up the coating. They allow for a relatively thick coating; e.g. 0.2 mil, without formation of a powdery surface. Colloidal silica which plays a major part in allowing for a thick coating, unfortunately has a tendency to pick up water. This tendency is, however, minimized by the addition of hexavalent chromium. Significantly, additions of trivalent chromium do not provide the same advantages as do additions of hexavalent chromium. In humid atmosphere a somewhat tacky surface is attributable to the use of trivalent chromium. Phosphate ion primarily serves as a binder and thereby allows for thicker coatings. Magnesium ion is generally present in amounts of at least 0.3%. It appears to allow for more hexavalent chromium in the coating solution without formation of a powder surface. Preferred levels for the interrelated substances of the coating solution are as follows: 8 to 19% phosphate ion, 0.6 to 3.5% magnesium ion, 9 to 23% colloidal silica and 0.2 to 3.5% hexavalent chromium. Also includable within the coating solution are wetting agents, pigments or dies for identification, and insert solids as fillers and/or extenders.

To those skilled in the art, it is obvious that the above-described solutions may be made from various ingredients. For instance, magnesium ion may be added as magnesium phosphate or magnesium chromate or as the oxide or hydroxide of magnesium; and even though the phosphate or chromate of magnesium may be used, additional sources of phosphate ion and/or hexavalent chromium may be required. It should further be noted, that depending on the pH of the solution, the phosphate ions will be in equilibrium with various protonated forms. Likewise, the hexavalent chromium will be in equilibrium between forms showing various degrees of protonation and complex formation.

Curing of the coating is a time and temperature dependent process. A metal temperature of as low as 1200° F is acceptable, but metal temperatures of at least 1400° F are preferred. Times cannot be precisely set forth as they, of course, are dependent upon temperature and other variables. As it is generally desirable to stress relieve the steel, after the final texture anneal, curing and stress relief annealing can be simultaneously carried out. Stress relief annealing is generally performed at temperatures of from 1475°–1550° F.

The article of the subject invention is partially described in terms of the aqueous solution from which the coating originates, as it is not possible to definitely state what chemical products actually form on the steel. It is, however, speculated that the phosphate ion forms a polymeric polyphosphate that is modified by the other additives of the coating.

Tension determinations can be arrived at by known methods which relate deflection to tension. With regard to this, attention is directed to an article by A. Brenner and S. Senderoff appearing in Volume 42 (1949), page 105 of the Journal of Research of the National Bureau of Standards. The deflection of the free end of a strip of silicon steel is determined by clamping the other end, mounting the strip in a horizontal position, and removing the coating from only one side using an acid solution.

The following examples are illustrative of several aspects of the invention.

A number of specimens of grain-oriented silicon steel where cut, in the form of Epstein strips, from sheets 0.012 inch thick. The strips were stress relief annealed at a temperature of 1475° F for 120 minutes in an atmosphere consisting of 80% nitrogen and 20% hydrogen, and assembled into five Epstein packs (A, B, C, D and E) containing 12 strips. Core losses, in watts per pound, for the packs was then determined at an induction of 17KG. The results of the tests appear hereinbelow in Table I.

TABLE I

| Pack | Core Loss |
|---|---|
| A | 0.680 |
| B | 0.667 |
| C | 0.654 |
| D | 0.699 |
| E | 0.682 |

Each pack was coated, using a roll coater, with a different solution. The compositions of the solutions are set forth hereinbelow in Table II. Packs A, B, C, D and E were respectively coated with solutions A, B, C, D and E.

TABLE II

| Coating Solution | Composition (Wt. %) [1] $Mg^{++}$ | [2] $PO_4^{\equiv}$ | Colloidal Silica | Hexavalent[3] Chromium | Water |
|---|---|---|---|---|---|
| A | 0.97 | 13.4 | 15.2 | 0.4 | Bal. |
| B | 1.7 | 14.2 | 12.9 | 2.2 | Bal. |
| C | 1.6 | 17.1 | 13.8 | 0.7 | Bal. |
| D | 0 | 15.2 | 13.4 | 0.5 | Bal. |
| E | 1.8 | 14.8 | 13.1 | 0.3 | Bal. |

[1]Supplied as magnesium oxide
[2]Supplied as phosphoric acid
[3]Supplied as chromium trioxide The coated packs were cured by placing them in a furnace at 1300° F for 45 seconds, and subsequently stress relief annealed in air for one hour at 1475° F. Core losses, in watts per pound, for the packs were then determined at an induction of 17KG. The results of the tests appear hereinbelow in Table III.

TABLE III

| Pack | Core Loss |
|---|---|
| A | 0.631 |
| B | 0.636 |
| C | 0.601 |
| D | 0.651 |
| E | 0.635 |

The data in Tables I and III, indicate that the articles of this invention made in accordance with the process of this invention, result in silicon steel having lower core losses than the same material prior to being coated in accordance with this invention. For example, Pack A had a core loss of 0.68 prior to coating and 0.631 after coating. A significant decrease, indeed.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

I claim:

1. As an article of manufacture, grain-oriented silicon steel having a cube-on-edge orientation and a cured coating thereon, said coating having been essentially of from 4 to 30% phosphate ion, 0.3 to 6% magesium ion, 5 to 34% colloidial silica, 0.15 to 6% hexavalent chromium, balance water; said cured coating placing said steel in tension, said tension being at least 800 psi.

2. An article according to claim 1, wherein said tension is at least 1200 psi.

3. In a process for producing grain-oriented silicon steel, which process includes the steps of: preparing a melt of silicon steel; casting said steel; hot rolling said steel; cold rolling said steel; decarburizing said steel; and final texture annealing said steel; the improvement comprising the steps of coating said annealed steel with an aqueous solution consisting essentially of from 4 to 30% phosphate ion, 0.3 to 6% magnesium ion, 5 to 34% collodial silica, 0.15 to 6% hexavalent chromium, balance water, heating said coated steel at a temperature of at least 1200° F to cure said coating, and cooling said coated steel, said coating placing said steel in tension during said cooling thereof, said tension being at least 800 psi.

4. The improvement according to claim 3, wherein said coated steel is heated at a temperature of at least 1400° F.

5. The improvement according to claim 3, wherein said aqueous solution contains from 8 to 19% phosphate ion 0.6 to 3.5% magnesium ion, 9 to 3.5% hexavalent chromium.

6. The improvement according to claim 3, wherein said melt consists essentially of by weight, up to 0.07% carbon from 2.6 to 4.0% silicon, from 0.03 to 0.24% manganese, from 0.01 to 0.09% of material from the group consisting of sulfur and selenium, from 0.015 to 0.04% aluminum, up to 0.02% nitrogen, up to 0.5% copper, up to 0.0035% boron, balance iron, and wherein said oriented steel has a cube-on-edge orientation.

7. An improvement according to claim 3, wherein said tension in said steel is at least 1200 psi.

* * * * *

UNITED STATES PATENT OFFICE
CERTIFICATE OF CORRECTION

PATENT NO. : 4,032,366

DATED : June 28, 1977

INVENTOR(S) : Edward G. Choby, Jr.

It is certified that error appears in the above-identified patent and that said Letters Patent are hereby corrected as shown below:

Claim 1, line 14, the following should be added after the word "been" and before the word "essentially" --formed from an aqueous solution consisting--.

Claim 5, line 41, the following should be added after the word "ion," and before "9" --9 to 23% colloidal silica and--.

Claim 5, line 41, "9 to 3.5% hexavalent chromium" should read --0.2 to 3.5% hexavalent chromium--.

Signed and Sealed this

*Sixth* Day of *November 1979*

[SEAL]

*Attest:*

RUTH C. MASON
*Attesting Officer*

LUTRELLE F. PARKER
*Acting Commissioner of Patents and Trademarks*